US005745441A

United States Patent [19]

Dunsbergen et al.

[11] Patent Number: 5,745,441

[45] Date of Patent: Apr. 28, 1998

[54] MECHANICAL TIMER INCLUDING CAM OPERATED CLAPPER AND CHIMES

[75] Inventors: Kirk M. Dunsbergen; Daniel F. Wunderlich; Michael D. Lafrenz, all of Newton, Iowa

[73] Assignee: Maytag Corporation, Newton, Iowa

[21] Appl. No.: 620,101

[22] Filed: Mar. 21, 1996

[51] Int. Cl.[6] ..... G04F 3/00; H01H 43/00

[52] U.S. Cl. ..... 368/100; 200/38 R; 200/38 BA

[58] Field of Search ..... 368/89, 107, 109, 368/243, 244, 250, 254, 269, 97–100; 200/19 R–31 A, 35 R, 33 R, 38 R, 38 B, 38 BA, 38 C, 38 CA

[56] References Cited

U.S. PATENT DOCUMENTS

| | | | |
|---|---|---|---|
| 2,906,329 | 9/1959 | Frere et al. | 200/33 D |
| 3,818,157 | 6/1974 | Voland et al. | 200/38 B |
| 3,862,385 | 1/1975 | Johnson | 200/38 R |
| 3,886,802 | 6/1975 | Mason | 200/38 R X |
| 4,001,528 | 1/1977 | Deane et al. | 200/38 R |
| 4,020,625 | 5/1977 | Mahon et al. | 368/100 |
| 4,103,119 | 7/1978 | Homan et al. | 200/35 R |
| 4,242,746 | 12/1980 | Schuder et al. | 368/109 |
| 4,412,750 | 11/1983 | Schuder et al. | 368/98 |
| 4,418,271 | 11/1983 | Smock | 219/493 |
| 4,490,589 | 12/1984 | Voland | 200/38 |
| 4,538,037 | 8/1985 | Amonett | 200/38 R |
| 4,616,209 | 10/1986 | Mahon | 200/38 R X |
| 4,867,005 | 9/1989 | Voland | 74/568 T |
| 5,214,310 | 5/1993 | Adams | 307/141 |

*Primary Examiner*—J. R. Scott
*Attorney, Agent, or Firm*—Zarley, McKee, Thomte, Voorhees, & Sease

[57] ABSTRACT

A timer mechanism for an appliance such as a clothes dryer includes a pulser cam and a timer cam. The timer cam has a notch along its perimeter while the pulser cam has a step formed in its perimeter. The cams rotate in opposite directions with a cam follower biased against the cams. A clapper is connected to the cam follower and is adapted to strike a chime if the cam follower is aligned with the notch in the timer cam and the cam follower drops off the step in the pulser cam as the pulser cam rotates past the cam follower. The pulser cam is connected to the timer motor and continuously rotates at a first speed throughout a cycle while the timer cam is connected to the timer motor and the timer dial of the appliance and rotates in the opposite direction at a second slower speed.

17 Claims, 4 Drawing Sheets

MECHANICAL TIMER INCLUDING CAM OPERATED CLAPPER AND CHIMES

BACKGROUND OF THE INVENTION

The present invention relates to appliance timers. More particularly, the present invention relates to a timer mechanism for mechanically striking a chime.

A typical prior art appliance timer has a constant rotating cam that provides a means for intermittently providing electrical contact closure for signaling processes.

In appliances such as washers and dryers, timers for controlling the operation of the appliance are essential. The timers control the operation of the appliance as well as controlling buzzers and the like for signaling a user that a cycle is complete for example.

A typical clothes dryer includes a cool down, press care, or anti wrinkle cycle at the end of the drying cycle. At the end of the drying cycle a buzzer sounds to remind the user that the cycle is complete. The dryer control will continue to remind the user until the clothes are removed or until a predetermined amount of time has elapsed.

On a typical prior art appliance, electrically activated alarms such as buzzers along with the electrical contacts required to activated them are expensive to produce. A need can therefore be seen for an effective economical mechanically driven timer signal.

A general object of the present invention is the provision of a mechanical timer mechanism.

A further object of the present invention is the provision of a mechanical timer mechanism which mechanically activates an alarm signal at a desired time.

A further object of the present invention is the provision of a mechanical timer mechanism which does not sound the alarm signal when the user is manually turning the timer dial.

A further object of the present invention is the provision of a mechanical timer mechanism which uses two cams to mechanically activate an alarm signal.

A further object of the present invention is the provision of a mechanical timer mechanism which will mechanically sound a chime at certain intervals.

A further object of the present invention is the provision of a mechanical timer mechanism with a selectively on or off chime signal.

A further object of the present invention is the provision of a mechanical timer mechanism that is economical to produce.

These as well as other objects of the present invention will become apparent from the following specification and claims.

SUMMARY OF THE INVENTION

The timer mechanism of the present invention is operable for mechanically striking a chime to alert a user of a certain event. The timer mechanism includes a pulser cam and a timer cam. The pulser cam has a step formed on its perimeter while the timer cam has an indentation formed on its perimeter. A cam follower is biased against the two cams and has a clapper connected to it. When the indentation of the timer cam is aligned with the cam follower and the cam follower drops over the step of the pulser cam, the clapper will strike the chime.

The pulser cam may be connected to a timer motor which rotates continuously during the operation of the timer mechanism. The timer cam may also be connected to the timer motor and rotates in the opposite direction in relation to a selected operation cycle.

BRIER DESCRIPTION OF THE DRAWINGS

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalences which may be included within the spirit and scope of the invention.

Figure 1:
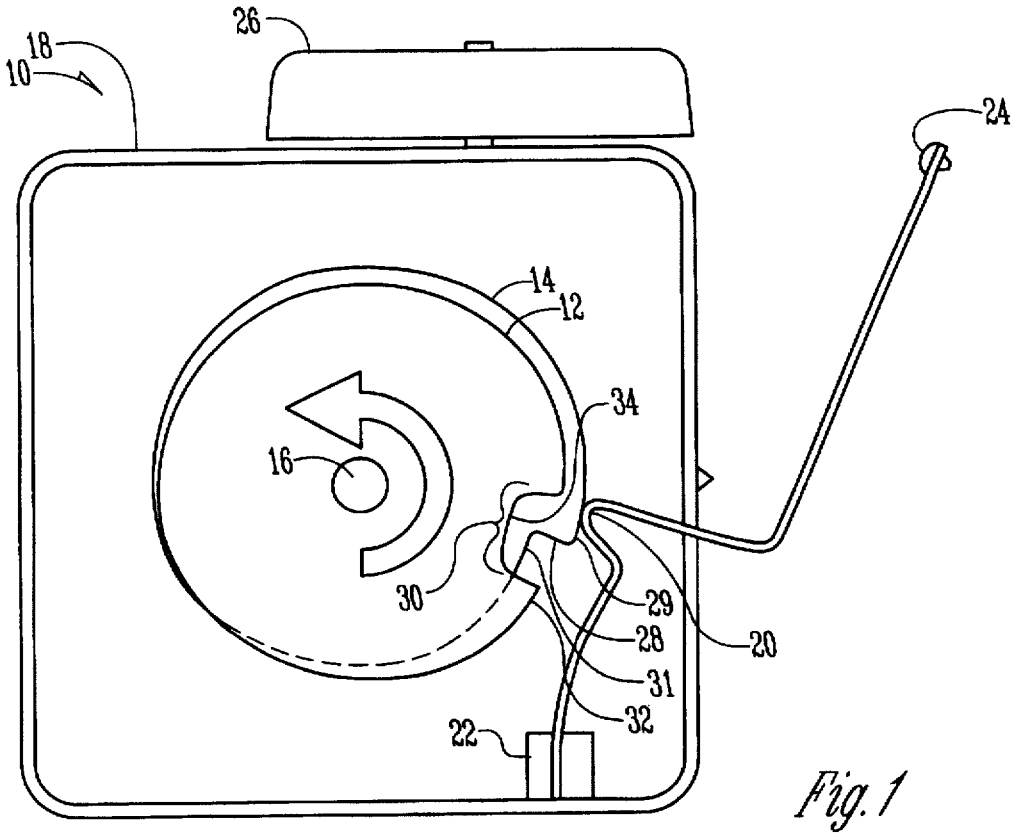
FIGS. 1–3 show a timer mechanism of the present invention at different time intervals.

FIG. 1 shows a mechanical timer mechanism 10 of the present invention. Two cams, a timer cam 12, and a pulser cam 14 are each rotatable about a shaft 16. The cams 12 and 14 are housed within a housing 18. A cam follower 20 is affixed to the housing by mounting means 22. The cam follower 20 is preferably comprised of a spring-like metal which biases the cam follower 20 towards the timer cam 12 and pulser cam 14. The cam follower 20 is wide enough that it is capable of contacting both cams 12 and 14. Coupled to the cam follower 20 is a clapper 24 which will strike a chime 26 under certain conditions discussed below. The cam follower 20 and clapper 24 serve a multifunctional role in the present invention. They function as a cantilever spring, a cam follower, and a clapper arm.

The pulser cam 14 includes a step 28 formed on the perimeter of cam 14. One side of the step has a high side 29 and a low side 31. Pulser cam 14 has a diameter that gradually increases from the diameter at the low side 31 to the diameter at the high side 29 of step 28. As viewed in FIGS. 1–3, the pulser cam 14 rotates in a counterclockwise direction preferably at a rate of 12 revolutions per hour. The pulser cam 14 is coupled to a timer motor (not shown) and constantly rotates at this rate. As the pulser cam 14 rotates counterclockwise, the cam follower 20 and clapper 24 are slowly biased towards a state of increased potential energy (FIG. 1). The cam follower 20 will remain energized in this state until the step 28 passes the cam follower 20. At this point the cam follower 20 will drop toward one of two levels on the timer cam 12. The timer cam 12 includes a notch 30 which forms an upper level 32 and a lower level 34. When the cam follower 20 drops over the step 28 it will drop toward the lower level 34 or the upper level 32 of the timer cam 12 depending on the position of the timer cam 12 which, in this embodiment, is rotating in a clockwise direction at a rate of ⅓ revolution per hour. The upper level 32 will not permit the clapper 24 to strike the chime 26. If the lower level 34 of the timer cam 12 is aligned with the step 28 on the pulser cam 14 (FIG. 3), the clapper 24 will momentarily strike the chime 26. Since the pulser cam 14 completes one rotation every five minutes, this sequence will repeat in five minute intervals as long as the notch 30 in the timer cam 12 is aligned with the step 28 on the pulser cam 14.

The present invention also prevents the clapper 24 from striking the chime 26 when the user turns the timer dial (not shown) of the appliance through the shaft 16. When the user turns the timer dial on the appliance, the timer cam 12 rotates with the dial. The cam follower 20 and clapper 24 are designed such that the clapper 24 will have enough energy to strike the chime 26 only when the cam follower 20 drops over the step 28 of the pulser cam 14 towards the lower level 34 of the timer cam 12. Even if the appliance is stopped with the drop off of the step 28 of the pulser cam 14 aligned with the cam follower 20 and the timer cam 12 is turned, the drop off from the upper level 32 of the timer cam 12 to the lower level 31 of the pulser cam 14 is not enough of a drop to enable the clapper 24 to strike the chime 26. As a result, the only way that the clapper 24 will strike the chime 26 is if the notch 30 of the timer cam 12 is aligned with the cam follower 20 and the pulser cam 14 rotates and causes the cam follower 20 to drop over the step 28.

Figure 2:
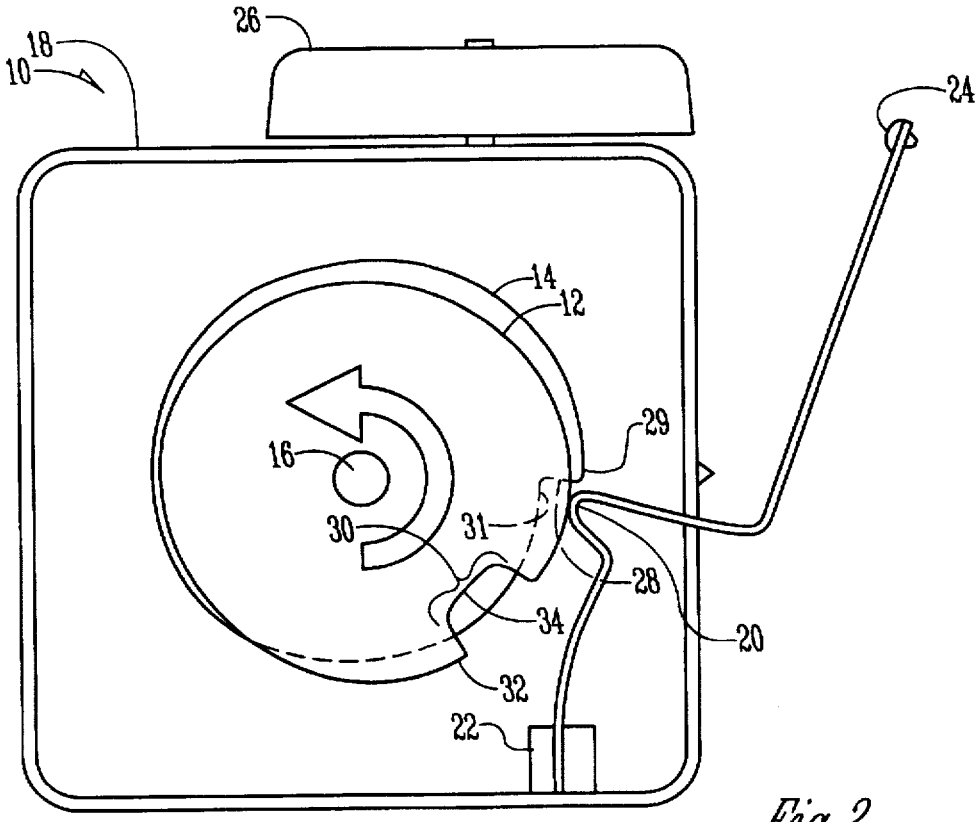
Figure 3:
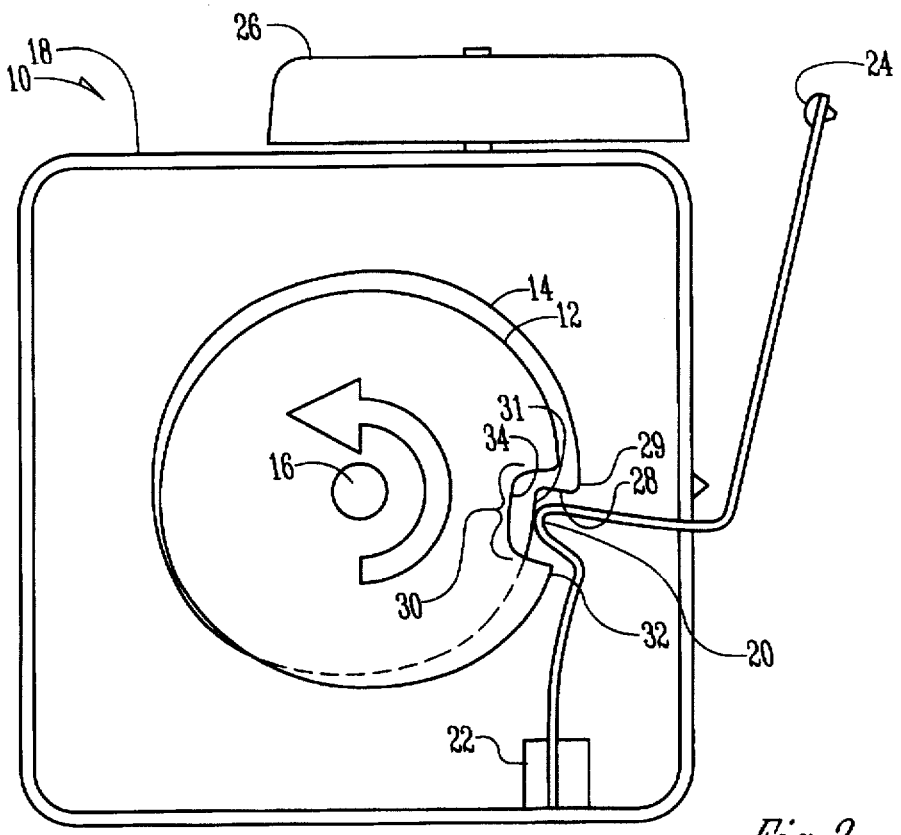

FIGS. 1–3 show the described embodiment at three different time intervals. FIG. 1 shows the timer mechanism 10 slightly before the chime is struck by the clapper 24. As shown, the step 28 of the pulser cam 14 will pass the cam follower 20 as it rotates counterclockwise. When the cam follower 20 is dropped over the step 28 the cam follower 20 will drop towards the notch 30 of the timer cam 12 causing the clapper 24 to strike the chime 26. FIG. 2 shows the timer mechanism 10 after that cam follower 20 has passed the step 28. However, the clapper 24 will not strike the chime 26 since the cam follower 20 can only drop from the top of the step 28 to the upper level 32 of the timer cam 12. As discussed above, this drop off does not create enough energy for the clapper 24 to strike the chime 26. FIG. 3 shows the timer mechanism 10 after the chime 26 has rung. As shown in FIG. 3, the cam follower 20 has already dropped over the step 28 toward the lower level 34 of the timer cam 12. Although the clapper 24 as shown is a certain distance from the chime 26, when the cam follower 20 drops, it drops with enough energy to cause the clapper 24 to strike the chime 26 since the cam follower 20 is made from a spring-like material.

If the user turns the timer dial of the appliance to rotate the timer cam 12 while the pulser cam 14 is in the position of FIG. 3, the clapper 24 will not strike the chime 26 as the cam follower 20 drops from the upper level 32 of the timer cam 12 to the lower level 31 of the pulser cam 14 since the cam follower 20 and clapper 24 are designed to only have enough energy to strike the chime 26 when the cam follower 20 is dropped from the upper side of the step 28 toward the lower level 34 of the timer cam 12.

Figure 4:
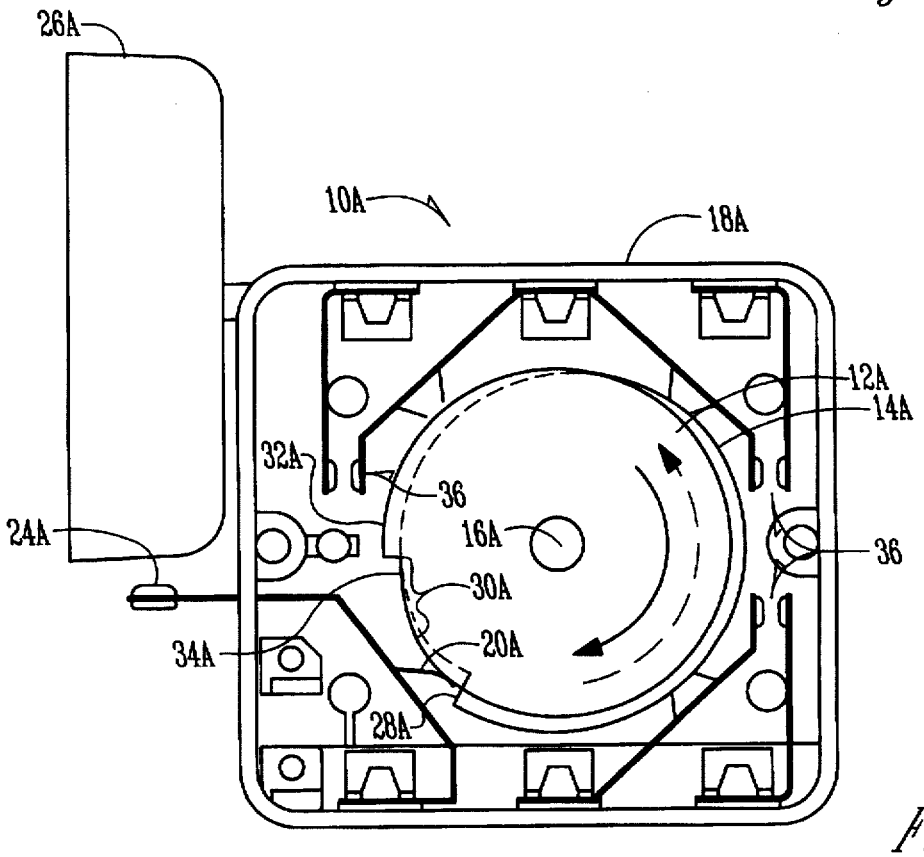
FIGS. 4 and 5 show a second embodiment of the present invention at different time intervals.
Figure 5:
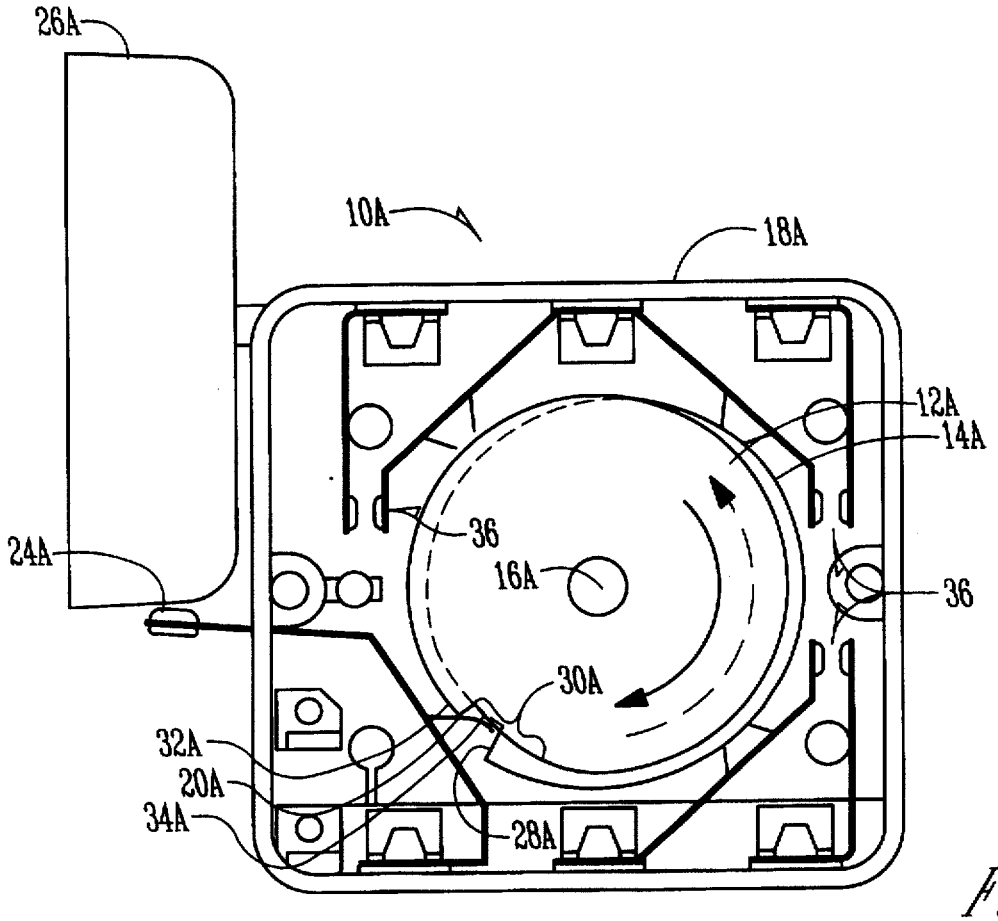

FIGS. 4 and 5 show the preferred embodiment of a timer mechanism 10A which can be used with a clothes dryer. The timer mechanism 10A includes a timer cam 12A and a pulser cam 14A which function as described above. The pulser cam 14A rotates in a counterclockwise direction as indicated by the dashed line arrow at approximately 12 revolutions per hour. The timer cam 12A rotates in a clockwise direction as indicated by the solid line arrow at a rate of approximately ⅓ revolutions per hour. These are the preferred rotation rates. However, any suitable rotation rate or direction of rotation may be used with the present invention. The cams 12A and 14A both rotate about a shaft 16A and are housed in a housing 18A. A cam follower 20A is biased against the cams 12A and 14A much like the cam follower 20 in FIGS. 1–3. A clapper 24A is coupled to the cam follower 20A and will strike the chime 26A under the appropriate conditions. The pulser cam 14A includes a step 28A which forms a drop off in the pulser cam 14A. The timer cam 12A includes notch 30A formed at its perimeter. The timer cam 12A has an upper level 32A on the outside of the notch 30A on either side and a lower level 34A which is within the notch 30A. The timer mechanism 10A shown in FIG. 4 also includes a number of electrical contacts 36 which may be used for various functions of a clothes dryer or other appliance.

Like the timer mechanism 10 shown in FIGS. 1–3, the clapper 24A will only strike the chime 26A when the cam follower 20A drops over the step 28A and the cam follower 20A is also aligned with the notch 30A. The notch 30 or 30A can be comprised of any form as long as a lower level and upper level is formed along the perimeter of the timer cam 12.

The present invention operates as follows. As an example, the operation of the timer mechanism 10A will be described as used with a clothes dryer. When the dryer is turned on, the pulser cam 14A will constantly rotate in a counterclockwise direction at a rate of approximately 12 revolutions per hour or once every five minutes. When the user selects a drying cycle by turning the timer dial of the dryer, the timer cam 12A will be set at the appropriate position. When the drying cycle starts, the timer cam 12A will rotate in a clockwise direction at a rate of approximately ⅓ revolution per hour. Approximately every 5 minutes the cam follower 20A will drop over the step 28A of pulser cam 14A. However, the clapper 24A will not strike the chime 26A since the drop off distance over the step 28A to the upper level 32A of the timer cam 12A is not sufficient to cause the clapper 24A to strike the chime 26A. However, when the notch 30A becomes aligned with the cam follower 20A and the cam follower 20A drops over the step 28A, the total drop off distance will be enough to cause the clapper 24A to strike the chime 26A, signaling the user that the drying cycle is over. When the user manually turns the timer dial on the dryer and the notch 30A passes the cam follower 20A, the clapper 24A will not strike the chime 26A regardless of the position of the pulser cam 14A. This prevents annoyance and confusion to the user. During the operation of the dryer, the cams may also actuate the various electrical contacts 36 to control various aspects of the dryer.

Figure 7:
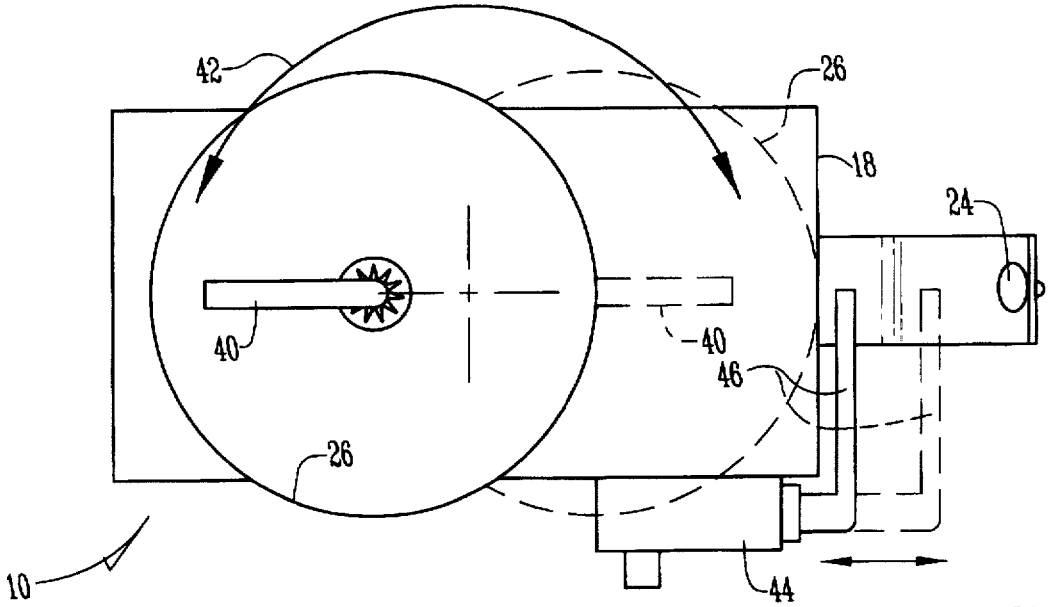
FIGS. 6 and 7 show the timer of the present invention with a chime that is selectively movable with respect to the clapper and with a mechanism for blocking movement of the clapper.
Figure 6:
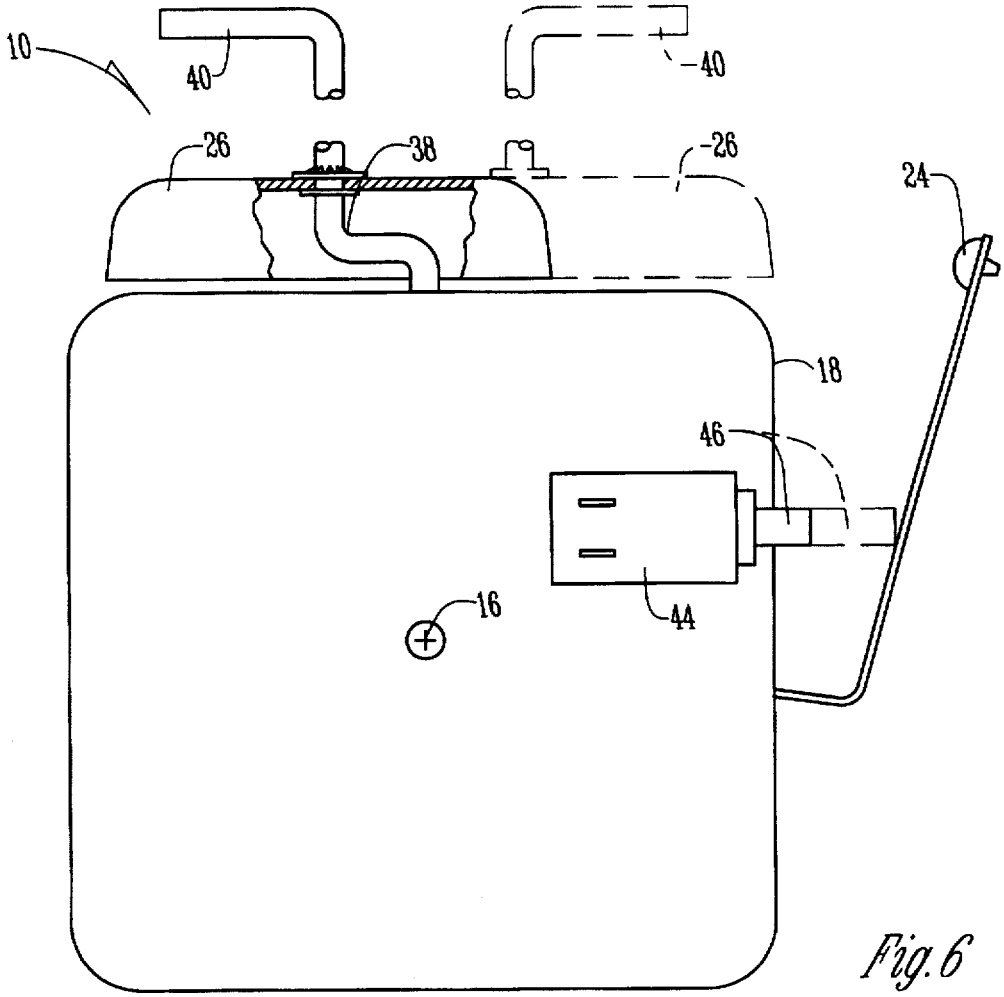

In order to provide an arrangement wherein the chime signal can be manually selectively turned "on" and "off", an embodiment such as that shown in FIGS. 6 and 7 is utilized. In this embodiment, the chime 26 is pivotally mounted to the timer housing 18 through an offset lever 38. The lever 38 would be configured so that an operating arm 40 would extend through an adjacent wall of a control panel (not shown) and be positioned so that the appliance user can selectively operate the lever 38 with respect to the housing 18 as shown by arrow 42 to move the chime 26 into the phantom line "on" position where it can be struck by the clapper 24. Alternately, the chime 26 could be moved to the solid line "off" position.

FIG. 7 shows, at arrow 42, the lever 38 operating through an arcuate path of substantially 180 degrees between the "on" and "off" postures of the chime 26. It is readily apparent that the lever 38 can be moved through a much smaller angle or even in a straight line and accomplish the placement of chime 26 either into or out of position to be struck by clapper 24. Also, while not shown, it is envisioned that detents would be located at each position to engage and effectively hold lever 38 in position.

The selective "on-off" option can also be provided by various devices operable for blocking movement of the clapper 24 into contact with chime 26. For example, as further shown in FIGS. 6 and 7, a wax motor actuator 44 may be mounted to the housing 18 and when actuated would extend a shaft 46 to block movement of the clapper 24. The circuit for the wax motor actuator 44 would be manually controlled by a switch (not shown). Various other electromechanical devices may be substituted for the wax motor actuator 44 to block movement of the clapper 24 and various mechanical mechanisms and linkages may be used without detracting from the spirit and scope of the present invention.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A timer mechanism comprising:

a first cam rotatable in a first direction, said first cam having a step formed on its perimeter;

a second cam rotatable independently from said first cam in a direction opposite said first direction about a common axis with said first cam, said second cam having an indentation formed on its perimeter;

a cam follower disposed proximate the perimeters of said first and second cams such that said cam follower can move in response to movement of said first and second cams;

a clapper coupled to said cam follower;

a chime disposed proximate said clapper; and wherein said cam follower causes said clapper to strike said chime when said cam follower is aligned with said indentation formed in said second cam and said step formed in said first cam moves past said cam follower.

2. The timer mechanism of claim 1 wherein said first cam is operatively coupled to a motor.

3. The timer mechanism of claim 2 wherein said first cam is constantly rotated by said motor during the operation of the timer mechanism.

4. The timer mechanism of claim 1 wherein said second cam is operatively coupled to a motor.

5. The timer mechanism of claim 4 wherein said motor causes said second cam to rotate.

6. The timer mechanism of claim 1 wherein said first cam rotates faster than said second cam.

7. The timer mechanism of claim 1 wherein said cam follower is comprised of a flexible material, said cam follower being biased toward said first and second cams.

8. The timer mechanism of claim 1 wherein said step has a high side and a low side and wherein said cam follower causes said clapper to strike said chime only when said cam follower is aligned with said indentation and said cam follower drops off the high side of said step.

9. The timer mechanism of claim 1 and further including attachment structure for attaching said chime to said mechanism, said attachment structure being operable for selectively moving said chime into proximation with said clapper.

10. The timer mechanism of claim 1 and further including movable blocking structure adjacent said clapper and selectively movable into engagement therewith for blocking said clapper from striking said chime.

11. A mechanical timer mechanism for an appliance comprising:

a first cam operatively coupled to a timer motor for rotation in a first direction, said first cam having a step formed on its perimeter, said step having a first diameter on one side of the step and a second diameter on the other side of the step, said first diameter being greater than said second diameter;

a second cam rotatable about a common axis with said first cam, said second cam being operatively coupled to said timer motor for independent rotation in a second direction opposite the first direction, said second cam having a notch formed on its perimeter, said second cam having a third diameter with a value between said first and second diameters outside the notch and a fourth diameter with a value less than said third diameter within said notch;

a cam follower disposed proximate the perimeters of said first and second cams such that said cam follower can move in response to the rotation of said first cam in said first direction and said second cam in said second direction, said cam follower being biased toward said first and second cams;

a clapper coupled to said cam follower;

a chime disposed proximate said clapper; and wherein said cam follower causes said clapper to strike said chime when said cam follower drops from said step on said first cam and said notch on said second cam is aligned with said cam follower.

12. The mechanical timer mechanism of claim 11 wherein said appliance is comprised of a clothes dryer.

13. The mechanical timer mechanism of claim 11 wherein said timer motor and first cam rotate continuously while the appliance is operating.

14. The mechanical timer of claim 11 wherein the rotation of the second cam is related to an operational mode chosen by a user of the appliance.

15. A method of striking a chime on a mechanical timer mechanism comprising the steps of:

providing a first and second cam, each of said cams being independently rotatable about a common axis, said first cam having a step formed on its perimeter, said second cam having a notch formed on its perimeter;

rotating said first and second cams independently of each other;

following the outer periphery of said cams with a cam follower; and striking said chime when said cam follower is aligned with said notch and said step on said first cam rotates past said cam follower.

16. The method of claim 15 further comprising the step of continuously rotating said first cam during the operation of the mechanical timer mechanism.

17. The method of claim 15 further comprising the step of initiating an operational cycle, wherein said second cam is rotated based on the operational cycle.

* * * * *